United States Patent [19]

Edelton et al.

[11] 4,429,633

[45] Feb. 7, 1984

[54] IMPACT IGNITER

[75] Inventors: Sören Edelton; Bo Peterson, both of Lindesberg, Sweden

[73] Assignee: Aktiebolaget Bofors, Bofors, Sweden

[21] Appl. No.: 271,763

[22] Filed: Jun. 9, 1981

[30] Foreign Application Priority Data

Jun. 25, 1980 [SE] Sweden ..... 8004682

[51] Int. Cl.[3] ..... F42C 15/36

[52] U.S. Cl. ..... 102/222; 102/238; 102/244

[58] Field of Search ..... 102/238, 245, 244, 224, 102/222, 223, 272

[56] References Cited

U.S. PATENT DOCUMENTS

| | | | |
|---|---|---|---|
| 2,084,218 | 6/1937 | Rémondy | 102/272 X |
| 2,782,717 | 2/1957 | Burri et al. | 102/238 |
| 3,177,810 | 4/1965 | Kipfer | 102/245 |
| 3,314,362 | 4/1967 | Irion | 102/245 |
| 3,353,489 | 11/1967 | Berger | 102/245 |
| 3,406,630 | 10/1968 | Müller | 102/222 |
| 3,500,748 | 3/1970 | Hager et al. | 102/222 |

*Primary Examiner*—David H. Brown

*Attorney, Agent, or Firm*—Pollock, Vande Sande & Priddy

[57] ABSTRACT

The invention deals with an impact igniter (1) for projectiles with a fuse (15) acting as a transport safety and delayed arming device. By partitioning off the fuse (15) and the striker pin (7, 17) located behind it forward in the projectile trajectory direction, and by leading some of the surrounding air which streams past the projectile, against the fuse (15) through channels (24, 31) angled in relation to the trajectory direction, the igniter has been made rain-safe without extending the arming time unacceptably.

16 Claims, 4 Drawing Figures

IMPACT IGNITER

TECHNICAL FIELD

This invention relates to an impact igniter for projectiles with a fuse which acts as a transport safety and delayed arming device. The invention also concerns a method for manufacturing such an igniter.

BACKGROUND ART

The primary advantage of an igniter according to the invention is that it is rain-safe. Previous types of fused igniters have ignited after arming even when struck by drops of water. This is a great disadvantage if one must open fire when it is raining as a great number of shells can be detonated long before they reach the target.

The general design of a fused impact igniter is based upon the fact that the igniter contains a conventionally designed rotor which, when the projectile is fired, strives to turn from a transport safety position to an armed position due to the centrifugal effect of rotation. To allow the rotor to turn, the striker pin, which in the transport safety position blocks the rotor, must be moved forward in the trajectory direction. This is prevented by a fuse formed like a locking washer and, located in the nose of the impact igniter. In earlier designs the fuse is located completely in the open at the furthest forward portion of the igniter. When the projectile is fired the surrounding air streams against and melts the fuse and the melted metal is carried away.

As soon as the fuse has melted, the rotor can then force the striker pin forward and turn to the armed position. The front end of the striker pin is then completely exposed in the opening which was originally covered by the fuse. A striker spring attempts to press the striker pin down into the ignition position. In order to retain the striker pin in the armed position until the projectile reaches its target, centrifugal locks comprised of balls, pendulums or similar devices have been used which have just been capable of retaining the striker pin in the armed position as long as the projectile has rotated sufficiently. When the projectile hits a target or its velocity has reduced sufficiently as with a miss, the centrifugal locking device has no longer been capable of functioning and the striker spring has forced the striker pin into the ignition position. As has already been pointed out, the front end of the striker pin has been completely unprotected from the front in the opening formerly covered by the fuse. This has meant that impact igniters of this type are activated if they happen to hit large rain drops which have directly contacted the front end of the striker pin.

DISCLOSURE OF THE INVENTION

The purpose of this invention is to offer a rain-safe impact igniter with a fuse as transport safety and delayed arming device.

The impact igniter according to this invention, contains a rotor which in the transport position is blocked in an already known way by its own striker pin. In the armed position, the striker pin is held away from the ignition position by a centrifugal locking device. The centrifugal locking device may comprise balls or be designed in some other already known way which provides the previously described self-ignition in the event of a miss.

The impact igniter according to this invention has been made rain-safe by separating the fuse and the striker pin located behind it from the direct flow of air, rain or the like, at a forward position in the projectile. Air flow channels are provided through which some of the surrounding air which streams past the projectile in flight is led into contact with the fuse to cause melting of the fuse. The separation of the fuse and striker pin from the airflow prevents drops of water from activating the igniter, yet the air is led via the channels past the fuse so that a sufficiently rapid arming of the igniter is ensured. The air channels are designed in such a way that any drops of water which strike the channel openings are broken down into small particles before they reach the front end of the striker pin. In this way it is impossible for even large drops of water to activate the igniter. One method of ensuring the drops of water are broken up in the channels is to place the channels at an angle.

According to the preferred embodiment of the invention, air enters the channels through an annular opening coaxial with and at the front of the igniter. From this annular opening the air proceeds towards the axis of the igniter at a rearward angle, eventually flowing into a central chamber in which the fuse is located and from which the air is led out via radial channels through the wall of the igniter. The fuse is located in the chamber and preferably is in the form of an eutectic ring. The front part of the igniter bears against the fuse either directly or via an intermediate part.

The invention also concerns a method of manufacture for the preferred design described above. According to this method of manufacture the fuse is located at the forward end of the igniter, just above the striker pin or its extension and in the front part of an open axial recess intended for the striker pin or its extension. Above the fuse is placed a safety washer having a hat-shaped cross-section with the wider brim facing downwards against the fuse washer or ring. The safety washer has a drilled recess on its underside, and radial grooves run along the underside of the brim.

These radial grooves align with the air exhaust openings through the igniter wall when the washer has been fitted in position. The air inlet channels are drilled through the forward facing cylindrical part of the safety washer at a rearward angle towards the igniter axis and through to the drilled recess on the underside of the safety washer. After the safety washer has been placed in position the front edge of the igniter is bent inwards towards the upper edge on the cylindrical part of the washer. In this context the bending is either done in such a way as to form an unbroken narrow annular opening, preferably 0.2 to 1.2 mm broad, between the safety washer and the igniter body, or the bending is done so that the safety washer protrudes forward with the front openings of the air channels to the front of the forward end of the igniter body. In this way angled inlet channels to lead the air flow against the fuse are achieved. Thus the flow path for air rushing to the fuse begins as a narrow annular opening and splits into a plurality of rearwardly angled channels extending into the recess in the underside of the safety washer from which the air flows via radial grooves. According to the second alternative of the invention the flow path for air begins directly as a plurality of rearwardly angled channels. With the exception of the actual inlets to the air flow path, both alternatives of the invention are identical. Radial outlets are drilled below the radial grooves to allow escape of the melted metal from the fuse. The narrow annular opening and the angled channels ensure that those drops of water which strike the igniter tip never reach the front surface of the striker pin intact. They are either too large to pass through the narrow annular opening and are forced aside or they are broken up in the angled channels into such fine particles that they are incapable of activating the igniter. On the other hand, separating the striker pin and fuse from the direct flow of air does not affect the function of the igniter when it hits the target as it is then completely activated as is the case with previously known types.

BRIEF DESCRIPTION OF THE DRAWINGS

The method and design of the invention are defined in the accompanying patent claims and are further described by the enclosed Figures.

Of these,

FIG. 1 shows a cross-sectional view of an impact igniter as described in the invention while

BEST MODE FOR CARRYING OUT THE INVENTION

Figure 1:
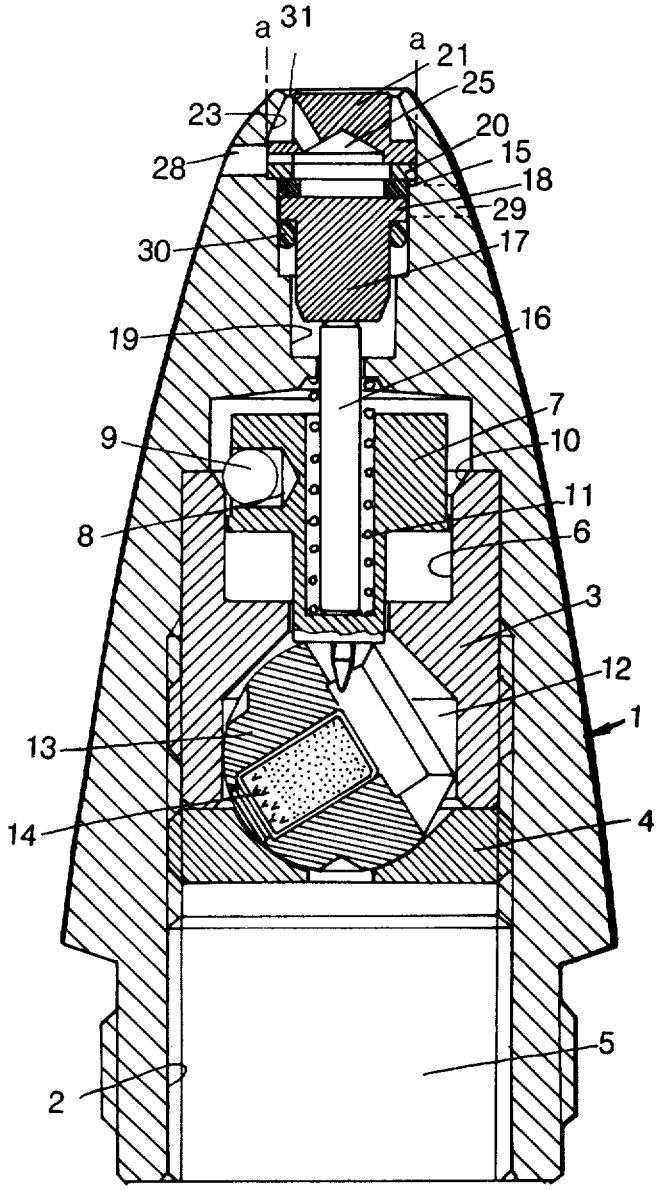

The igniter body 1 or housing member shown in FIG. 1 has a rear drilled recess 2 into which are screwed a rotor housing 3, a rotor retainer 4 and a reinforcement charge 5. A drilled recess 6 for the striker element or pin 7 is located at the front of the rotor housing. The striker pin is of an already known design with the locations such as a radial bores 8 for centrifugal locks in the form of balls 9 which, when the striker pin is forced rearwards under tension and the projectile is still rotating at full speed, are pressed by the centrifugal force against a conical surface 10 located at the front of the rotor housing. The striker spring 11 strives simultaneously to press the striker pin down into the armed position. Between the underside of the rotor housing and the rotor retainer is formed a chamber 12 for an already known type of rotor 13 which contains an ignition charge 14.

FIG. 1 shows the igniter in the transport safety position. To reach the armed position the striker pin 7 must be forced against the effect of the striker spring 11, forward towards the tip of the igniter. In the transport safety position this movement is prevented by the fuse 15. As soon as the fuse has melted, the influence of centrifugal force causes the rotor to turn which then forces the striker pin forward into the armed position. In this context the balls 9 make firm contact with the conical surface 10 and for as long as the full centrifugal force influences the balls, and the projectile does not strike a sufficiently firm body, the igniter will remain armed. When the projectile hits the target, or in the case of a miss, when the projectile rotation has reduced so much that the balls can no longer resist the tension of the striker spring 11 the igniter is detonated. Between the igniter and the fuse there is located an impact pin 16 and a spacer piece 17. The spacer piece 17 has an upper flange 18 of the same diameter as the fuse 15 against which it bears. The spacer piece is axially moveable within the drilled recess or chamber 19 located in the forward end of the igniter body. Between the spacer piece 17 and the striker pin 7, the impact pin 16 is located. These three parts move as a single unit. The previously described elements 3, 4, 7–14 and 16–18 thus constitute an arming mechanism located within the igniter body and operatively associated with the fuse 15. Directly under the flange 18 of the spacer piece 17 is located an O-ring 30 which seals against the wall of the drilled recess 19. This is necessary in order to ensure that no impurities reach the ignition elements lying immediately below. The spacer piece 17 is of such weight that it increases the safety function during the acceleration stage in as much as it makes it impossible for the rotor to turn to the armed position.

Figure 3:
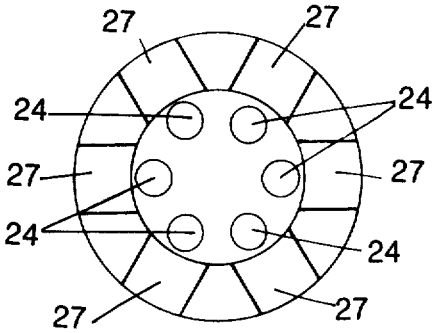
FIGS. 3 and 4 show on a larger scale an end view and a cross-sectional view of the safety washer included in the igniter as described in the invention.
Figure 4:
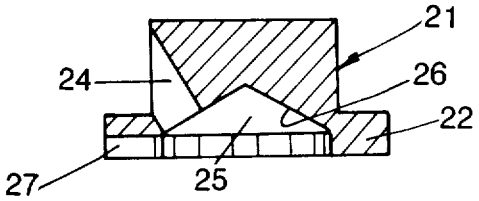

As has been mentioned previously, the eutectic ring-formed fuse 15 is located directly above the spacer piece flange 18. Above the fuse is located a spacer ring 20, and on top of the spacer ring 20 lies the unique safety washer 21 according to the invention. Washer 21 is shown in more detail in FIGS. 3 and 4. The safety washer is hat-shaped in cross-section with a wider brim 22 and is fitted in a forward drilled recess or chamber 23 located at the front of the igniter. The recess begins with straight sides which are shown in FIG. 1 by dashed lines marked a. The hat-shaped safety washer is placed in the drilled recess 23 with its wider brim 22 facing rearwardly and bearing against the spacer ring 20. In the forwardly facing cylindrical portion of the safety washer 21 there are a number of drilled channels 24 which run at an angle from the periphery in towards the longitudinal axis of the projectile to a chamber 25 which is formed by the recess 26 drilled in the rear of the safety washer and the space formed by the openings in the spacer ring 20 and the eutectic fuse ring 15. Along the underside of the brim 22 of the safety washer 21 run radial grooves 27 which align with the air exhaust channels or openings 28 drilled radially through the side wall of the igniter body when the safety washer is fitted in position. Under these air exhaust openings there is a radially drilled channel outlet 29 at the same height as the eutectic fuse ring 15 for the melted metal to pass through.

Figure 2:
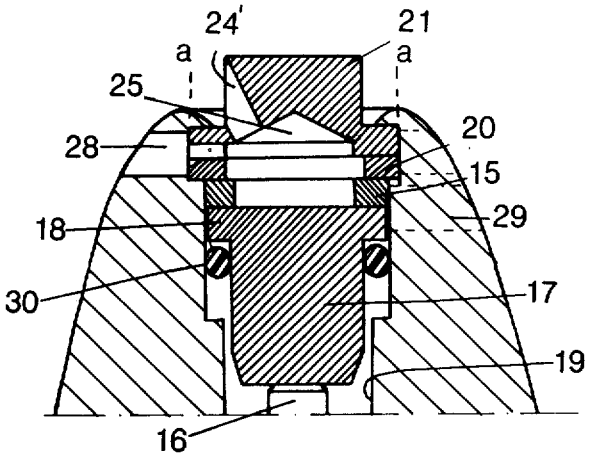
FIG. 2 shows on a larger scale an alternative design for partitioning off the fuse and the striker pin.

After the safety washer has been fitted in position the walls of the igniter at its forward tip are bent in to the position shown in either FIG. 1 or FIG. 2 so that the washer is clamped fast, and a complete, narrow forward facing, coaxial annular opening 31 is formed between the edge of the washer and the igniter wall as in FIG. 1. Or, the igniter front is pressed back sufficiently so that the part of the washer containing the mouths of the air inlet channels 24 protrudes forward from the front end of igniter body as in FIG. 2. A suitable width for annular opening 31 is 0,2–1,2 mm. A suitable diameter for the channels 24 in the safety washer is approximately 1 mm.

The above described designs produce a rain-safe fused impact igniter where the function of the fuse is ensured by the air channels 31, 24, 27, 28 while the functions of the igniter upon hitting a target and self-destruction upon missing a target, are ensured by well proven previously known techniques. The seal 30 around the spacer piece 17 protects the inner part of the igniter against humidity.

The design and method of the invention are not limited to the abovedescribed example. The definitions given in the patent claims apply instead in this respect.

We claim:

1. An improved igniter for attachment to the forward end of a projectile, comprising:

a housing member adapted to be positioned at the forward end of a projectile, said housing member having a longitudinal axis, a forward end and a side wall;

a chamber within said housing member;

a fuse located in said chamber, said fuse comprising a material which will melt when air streams against it following firing of a projectile;

an arming mechanism located in said housing member and operatively associated with said fuse, said arming mechanism contacting said fuse and being held in an unarmed configuration by said fuse while said fuse remains intact;

at least one first channel means leading from the exterior of said igniter inward to said chamber, said channel means being angled rearwardly from said forward end of said housing member toward said longitudinal axis, for leading a portion of the air streaming past the exterior of said igniter after firing of an associated projectile into said chamber and into contact with said fuse to cause said fuse to melt and to permit said arming mechanism to assume its armed configuration; and at least one second channel means leading from said chamber outward to the exterior of said igniter, for leading said portion of air back to the exterior of said igniter.

2. An improved igniter according to claim 1, further comprising a safety washer fitted at said forward end, said washer having a forwardly facing portion and a rearwardly facing portion, said rearwardly facing portion facing into said chamber to define a forward end of said chamber; said at least one first channel comprising a plurality of angled, radially extending channels passing through said safety washer, the inlet ends of said plurality of channels at least partially being forward of said forward end.

3. An improved igniter according to claim 1, wherein said at least one first channel means comprises a coaxial annular opening at said forward end and a a plurality of angled, radially extending channels leading from said annular opening into said chamber; and said at least one second channel means comprises a plurality of radially extending channels exiting through said side wall of said housing member.

4. An improved igniter according to claim 3, wherein said arming mechanism comprises a striker element extending into said chamber and contacting said fuse, further comprising seal means for preventing leakage from said chamber past said striker element.

5. An improved igniter according to claim 1, further comprising a hat-shaped safety washer having a forwardly facing cylindrical portion and a rearwardly-facing, radially extending brim portion, said brim portion facing into said chamber to define a forward end of said chamber; said at least one first channel extending through said cylindrical portion to said chamber; said at least one second channel extending along the rearward face of said brim portion; and a coaxial annular opening formed between said housing member and said cylindrical portion, said annular opening communicating with said at least one first channel.

6. An improved igniter according to claim 5, wherein said arming mechanism comprises a striker element extending into said chamber and contacting said fuse, further comprising seal means for preventing leakage from said chamber past said striker element.

7. An improved igniter according to claim 1, wherein said arming mechanism comprises a striker element extending into said chamber and contacting said fuse, further comprising seal means for preventing leakage from said chamber past said striker element.

8. An improved igniter according to claim 7, further comprising a safety washer fitted at said forward end, said washer having a forwardly facing portion and a rearwardly facing portion, said rearwardly facing portion facing into said chamber to define a forward end of said chamber; said at least one first channel comprising a plurality of angled radially extending chamber passing through said safety washer, the inlet ends of said plurality of channels at least partially being forward of said forward end.

9. An improved igniter according to claim 1, further comprising at least one third channel leading from said chamber for conveying melted fuse material to the exterior of said igniter.

10. An improved igniter according to claim 9, wherein said arming mechanism comprises a striker element extending into said chamber and contacting said fuse, further comprising seal means for preventing leakage from said chamber past said striker element.

11. An improved igniter according to claim 9, further comprising a hat-shaped safety washer having a forwardly facing cylindrical portion and a rearwardly facing, radially extending brim portion, said brim portion facing into said chamber to define a forward end of said chamber; said at least one first channel extending through said cylindrical portion to said chamber; said at least one second channel extending along the rearward face of said brim portion; and a coaxial annular opening formed between said housing member and said cylindrical portion, said annular opening communicating with said at least one first channel.

12. An improved igniter according to claim 11, wherein said arming mechanism comprises a striker element extending into said chamber and contacting said fuse, further comprising seal means for preventing leakage from said chamber past said striker element.

13. An improved igniter according to claim 1, further comprising at least one third channel leading from said chamber for conveying melted fuse material to the exterior of said ignition.

14. An improved igniter according to claim 3, further comprising a safety washer fitted at said forward end, said washer having a forwardly facing portion and a rearwardly facing portion, said rearwardly facing portion facing into said chamber to define a forward end of said chamber; said at least one first channel comprising a plurality of angled, radially extending chambers passing through said safety washer, the inlet ends of said plurality of channels at least partially being forward of said forward end.

15. An improved igniter according to claim 13, wherein said arming mechanism comprises a striker element extending into said chamber and contacting said fuse, further comprising seal means for preventing leakage from said chamber past said striker element.

16. An improved igniter according to claim 15, further comprising a safety washer fitted at said forward end, said washer having a forwardly facing portion and a rearwardly facing portion, said rearwardly facing portion facing into said chamber to define a forward end of said chamber; said at least one first channel comprising a plurality of angled, radially extending channels passing through said safety washer, the inlet ends of said plurality of channels at least partially being forward of said forward end.

* * * * *